US010301105B2

(12) United States Patent
van den Heijkant et al.

(10) Patent No.: US 10,301,105 B2
(45) Date of Patent: May 28, 2019

(54) CONTAINER, ASSEMBLY, SET, AND KIT OF PARTS

(71) Applicant: Pagter Innovations B.V., Roosendaal (NL)

(72) Inventors: Ruud van den Heijkant, Roosendaal (NL); Janus Adriaan Willem de Pagter, Roosendaal (NL)

(73) Assignee: Pagter Innovations B.V., Roosendaal (NL)

( * ) Notice: Subject to any disclaimer, the term of this patent is extended or adjusted under 35 U.S.C. 154(b) by 84 days.

(21) Appl. No.: 15/239,701

(22) Filed: Aug. 17, 2016

(65) Prior Publication Data

US 2017/0043941 A1 Feb. 16, 2017

Related U.S. Application Data

(63) Continuation-in-part of application No. PCT/NL2015/050098, filed on Feb. 17, 2015.

(30) Foreign Application Priority Data

Feb. 17, 2014 (NL) ..... 2012279
Feb. 19, 2016 (DE) ..... 20 2016 001 007 U

(51) Int. Cl.
*B65D 85/50* (2006.01)
*B65D 21/02* (2006.01)
(Continued)

(52) U.S. Cl.
CPC ..... *B65D 85/505* (2013.01); *A47F 7/0078* (2013.01); *B65D 21/0233* (2013.01);
(Continued)

(58) Field of Classification Search
CPC ..... B65D 85/505; B65D 21/083; B65D 21/0233; B65D 1/46; A47F 7/008; A47F 7/0078
(Continued)

(56) References Cited

U.S. PATENT DOCUMENTS 3,680,735 A 8/1972 Lucas
5,323,925 A 6/1994 Apps
(Continued)

FOREIGN PATENT DOCUMENTS

AU 632 357 B2 12/1992
DE 697 00 022 T2 3/1999
(Continued)

OTHER PUBLICATIONS

International Search Report and Written Opinion dated Jun. 22, 2015 for International Application No. PCT/NL2015/050098, 11 pages.

*Primary Examiner* — Mollie Impink
(74) *Attorney, Agent, or Firm* — Kilpatrick Townsend & Stockton LLP

(57) ABSTRACT

The invention relates to a container for cut flowers, the container being nestable, the container comprising a container body which at an upper region is provided with a channel-shaped sleeve holder for holding a protective sleeve arranged to protect cut flowers. The channel-shaped sleeve holder is open at its top. Further, the channel-shaped sleeve holder has an outer channel wall. The container further comprises at least one anti-interlocking flange extending downwardly from the channel-shaped sleeve holder. The anti-interlocking flange, or at least a bottom section of the anti-interlocking flange, is staggered with respect to the outer channel wall, or at least a top section of the outer channel wall.

17 Claims, 5 Drawing Sheets

(51) Int. Cl.

| | |
|---|---|
| ***B65D 43/02*** | (2006.01) |
| ***B65D 25/20*** | (2006.01) |
| ***A47F 7/00*** | (2006.01) |

(52) U.S. Cl.
CPC ..... *B65D 25/20* (2013.01); *B65D 43/02* (2013.01); *B65D 2501/2484* (2013.01); *B65D 2501/24541* (2013.01); *B65D 2501/24796* (2013.01); *B65D 2501/24847* (2013.01)

(58) Field of Classification Search
USPC ..... 47/41.11, 41.05; 206/516, 423
See application file for complete search history.

(56) References Cited

U.S. PATENT DOCUMENTS

| | | | | |
|---|---|---|---|---|
| 6,581,330 | B1 * | 6/2003 | Helsloot | B65D 85/505 206/423 |
| 6,752,270 | B1 * | 6/2004 | Helsloot | B65D 85/505 206/423 |
| 2013/0327736 | A1 * | 12/2013 | Del Olmo | B65D 85/505 211/85.8 |

FOREIGN PATENT DOCUMENTS

| | | | |
|---|---|---|---|
| DE | 20 2010 001795 | U1 | 7/2010 |
| JP | H08 133370 | A | 5/1996 |
| JP | 2003 204723 | A | 7/2003 |
| JP | 2013 223429 | A | 10/2013 |
| NL | 8901973 | A | 2/1991 |
| NL | 1 027 211 | C2 | 4/2006 |
| WO | 2006/041284 | A1 | 4/2006 |
| WO | 2015/183073 | A1 | 12/2015 |

* cited by examiner

CONTAINER, ASSEMBLY, SET, AND KIT OF PARTS

CROSS-REFERENCES TO RELATED APPLICATIONS

This application is a Continuation in Part of International Application No. PCT/NL2015/050098, filed Feb. 17, 2015, and which claims the benefit of Netherlands Patent Application No. 2012279, filed Feb. 17, 2014, and this application claims priority to German Patent Application No. 202016001077.9, filed Feb. 19, 2016, the disclosures of which are incorporated herein by reference.

BACKGROUND OF THE INVENTION

The invention relates to a nestable cut flower container for holding cut flowers.

Such containers are known, and widely used in the cut flowers industry, for example for transporting, storing, and/or displaying cut flowers. Typically, the containers, which usually are plastic injection moulded containers, are re-usable containers and are nestable in order to provide for reduced volume when empty. The cut flower containers can thus be nested into each other, which is an important aspect of these containers, for instance in order to store and/or transport empty containers in a space saving and thus relatively cost effective manner.

A typical nestable cut flower container comprises a base and four side walls extending upward from the base and together forming a circumferential wall. At an upper region, said cut flower container is provided with a channel-shaped sleeve holder for holding a protective sleeve arranged to protect cut flowers. Said channel-shaped sleeve holder is typically formed as a substantially U-shaped channel, which is open at its top, and which has an outer channel wall facing outwardly and an inner channel wall being substantially parallel with the outer channel wall. The inner wall of the channel forms the upper wall parts of the four upwardly extending side walls of the container. Each of said four side walls further comprise a relatively high lower wall part, also known as the wall or actual wall of the container. Normally, said lower wall parts are sloping such that the container is tapering in a downward direction towards its base. Due to the sloping lower wall parts, the cut flower container can be nestable. Usually, the inner channel wall is relatively high with respect to the outer channel wall, such that a protective sleeve, which is often formed a foldable strip of sheet material that comprises folding lines, can be supported on the outer side face of the inner wall of the channel when said protective sleeve is pressed there against when it is folded around cut flowers disposed in the container, which cut flowers are then often flaring outwardly, hanging over the channel, and have then thus to be pushed inwardly. The outer wall of the channel is relatively low with respect to said inner channel such that the protective sleeve can be moved over said outer channel wall towards the upper portion of the inner channel wall. In order to counteract a negative effect on the nesting height, the channels, especially their relatively low outer channel walls, are relatively low. A disadvantage of such low outer channel wall may lie in that the channels of two adjacent cut flower containers may slide onto each other, when stacked next to each other on a pallet for example. For instance, when the pallet is transported in a truck, the cut flowers have been placed into a cut flower container, a cardboard protective sleeve has been put into the U-formed upright channel and a lid has been put on the protection sleeve to provide for a surface on which another container can be positioned. These three elements can then typically be strapped together, e.g. by a polypropylene band. Such packages or so-called container assemblies can then be stacked on a pallet, for instance up to a height of about 240 to 250 centimeters, including the pallet. The stacked container assemblies may be strapped together and/or to the pallet, e.g. by a polypropylene band. When a truck drives, a pallet and/or one or more container assemblies thereon can be slightly moving, depending on the space between the pallets and/or the containers of each pallet. When the truck has an emergency stop or is driving on a hilly road, then a bottom of the channel of the adjacent container can slide on the top of the outer wall of the channel of the next container. The pallet then may become less stable. When it arrives at the distribution centre and is unstrapped by removing the strapping, the packages can tilt from the pallet. For instance thereto, anti interlocking flanges, such as corner flanges, have been proposed that extend downwardly from the outer channel wall. These anti interlocking flanges need to have a certain minimal height to reduce the risk of the adjacent containers sliding onto each other. For a conventional container, the anti-interlocking flange rests on the outer wall of the channel of a lower container when said containers are nested, thus the height of the anti interlocking flange may have a negative effect on the nesting height. Nevertheless, in conventional nestable cut flower containers, these anti interlocking flanges thus need a certain minimal height in order to prevent loosing its sliding prevention functionality.

BRIEF SUMMARY OF THE INVENTION

It is an object of the invention to provide an alternative nestable cut flower container. In particular, it can be an object of the invention to provide a nestable cut flower container, wherein at least one of the disadvantages of the prior art cut flower containers is counteracted or reduced at least partly. More in particular, the invention may aim to provide a nestable cut flower container, wherein at least one of the disadvantages mentioned above is counteracted. In embodiments, the invention aims at providing a nestable cut flower container with a relatively low nesting height at the one hand, and which can provide a certain sliding prevention on the other hand, preferably a sliding prevention, which is not substantially inferior to the known relatively high anti-interlocking flanges.

Thereto, the invention provides for a nestable cut flower container, comprising a container body which at an upper region is provided with a channel-shaped sleeve holder for holding a protective sleeve arranged to protect cut flowers, wherein the channel-shaped sleeve holder has an outer channel wall and at least one anti-interlocking flange extending downwardly from the outer channel wall, wherein the anti-interlocking flange, or at least a bottom section of said anti interlocking flange, is staggered with respect to the outer channel wall, or at least a top section of said outer channel wall.

By offsetting the anti-interlocking flange, or at least a bottom section thereof, in a sideward direction with respect to the outer channel wall, or at least a top section thereof, it may be enabled that, when the container is nested with a corresponding container, the bottom of the anti interlocking flange does not rest on the outer wall of the channel shaped sleeve holder of a lower container, but falls aside the outer wall of the channel-shaped sleeve holder of said lower container, thereby facilitating a relative small nesting height of the cut flower containers. The nesting height may then thus be reduced with respect to conventional nestable cut flower containers, without loosing the sliding prevention functionality of the anti-interlocking flange.

The anti-interlocking flange, or respective section thereof, can be placed outwardly or inwardly with respect to said outer channel wall, or respective section thereof, such that they can be positioned aside each other at least partly when corresponding cut flower containers are nested. In case the anti-interlocking flange, or at least its lower end portion, is staggered outwardly with respect to the outer channel wall, an inwardly facing side surface of the flange may there then thus be located further outwardly than the outwardly facing side surface of outer channel wall, or at least its bottom end portion. On the other hand, in case the anti-interlocking flange, or at least its lower end portion, is staggered inwardly with respect to the outer channel wall, an outwardly facing side surface of the flange may there then thus be located further inwardly than the inwardly facing side surface of the outer channel wall, or at least its bottom end portion.

In order to counteract that, in case the anti-interlocking flange is staggered inwardly, an edge located under the outer wall of the channel-shaped sleeve holder may unintentionally get stuck on top of the upper edge of an outer wall of a channel-shaped sleeve holder of an adjacent cut flower container, a sliding surface or slide may be positioned underneath the outer channel wall, e.g. between the lower end of said outer channel wall and the upper end of the anti-interlocking flange. Said slide or sliding surface may be tapered and may be sloping down in an inward direction.

In order to counteract that, in case the anti-interlocking flange is staggered outwardly, an edge located under the said flange may unintentionally get stuck on top of a corresponding anti-interlocking flange of an adjacent cut flower container, a sliding surface or slide may be positioned above said anti-interlocking flange, e.g. between the top edges of said flange and a lower end portion of the outer channel wall. Said slide or sliding surface may then be tapered and may be sloping down in an outward direction.

By arranging the nestable cut flower container such that it, in a substantially horizontal imaginary plane, has a substantially polygonal cross section, such as for instance a substantially rectangular, it may facilitate that multiple containers can be efficiently placed next to each other on a floor surface or pallet. Therefore, for instance a substantially triangular, a substantially hexagonal, and preferably a substantially rectangular, such as substantially square, cross-section can be highly advantageous.

In case of a cut flower container having upwardly extending corner edges, e.g. in case of a substantially polygonal cut flower container, the channel-shaped sleeve holder may be provided with an anti-interlocking flange or an anti-interlocking flange portion located near at least one corner or corner edge of the container. Preferably, the anti-interlocking flange located at or near a respective corner of the cut flower container can, in circumferential direction of the container, extend around said corner.

In embodiments, the anti-interlocking flange or at least one of the anti-interlocking flanges can be a corner flange. Since the corners of the channel-shaped sleeve holder are the most likely to slide onto each other, it can be advantageous to provide flanges at the position of said corners.

Nevertheless, the anti-interlocking flange may, in embodiments, substantially surround the circumference of the container.

It is noted that the invention also relates a set of containers, a container assembly for cut flowers, and a kit of parts. Said container assembly or said kit of parts may comprise a nestable cut flower container with an at least partly staggered anti-interlocking flange, and may further include a protective sleeve and/or a lid.

Advantageous embodiments according to the invention are described in the appended claims.

The invention will further be elucidated on the basis of exemplary embodiments which are represented in the drawings. The exemplary embodiments are given by way of non-limitative illustration of the invention.

DETAILED DESCRIPTION OF THE INVENTION

It is noted that the figures are only schematic representations of embodiments of the invention that are given by way of non-limiting example. In the figures, the same or corresponding parts are designated with the same or similar reference signs.

For the purpose of clarity and a concise description features are described herein as part of the same or separate embodiments, however, it will be appreciated that the scope of the invention may include embodiments having combinations of all or some of the features described.

Figure 1:
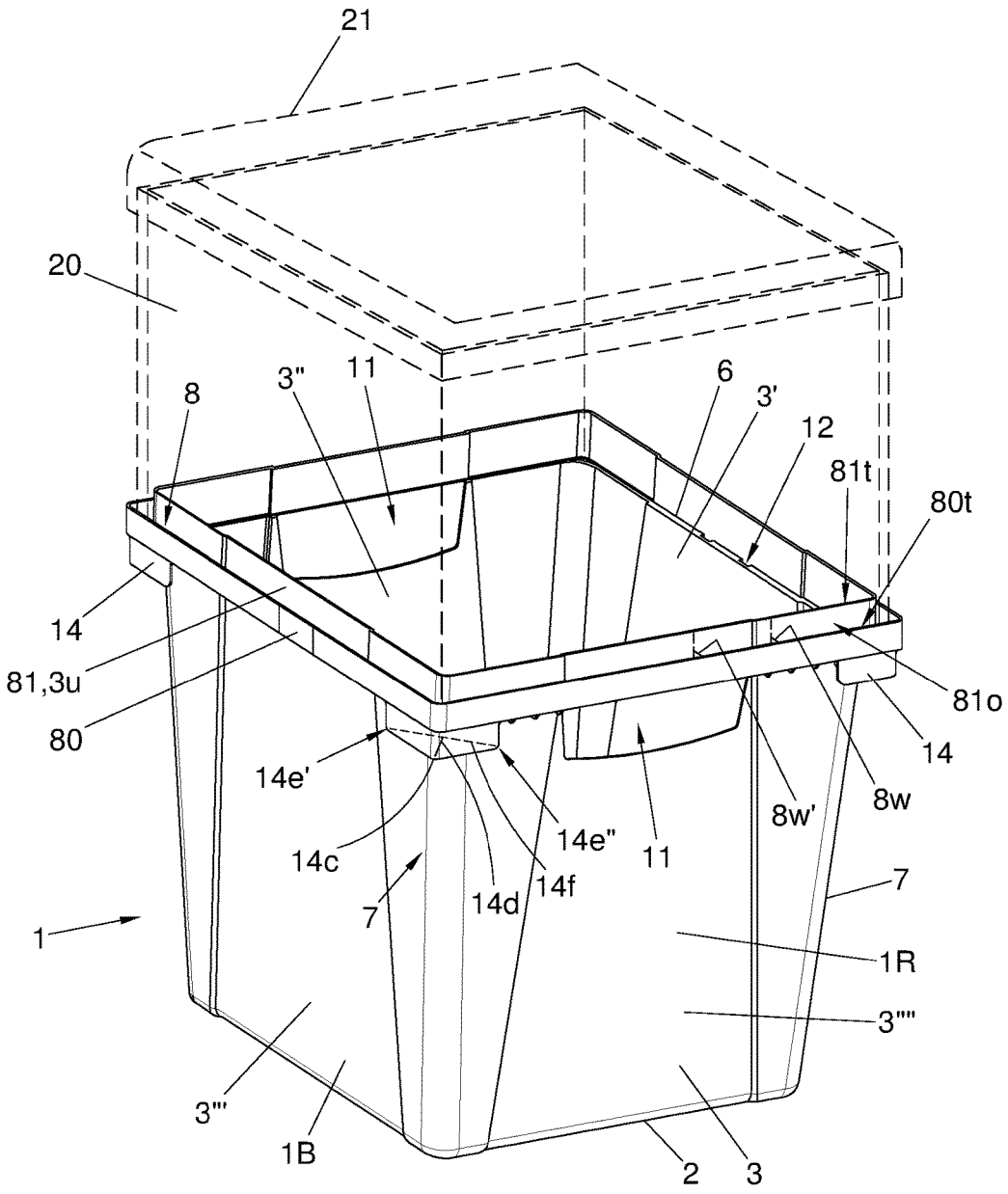
FIG. 1 shows a schematic perspective view of an embodiment of a nestable cut flower container according to an aspect of the invention.

FIG. 1 shows a schematic perspective view of an exemplary embodiment of a nestable cut flower container 1 according to an aspect of the invention. The container 1 comprises a container body 1B. The container 1, especially the container body 1B, is suitable for holding cut flowers, e.g. during transport, storage or display of the flowers, e.g. in a shop.

In embodiments, such as the embodiment of FIG. 1, the cut flower container 1 may for instance comprise four side walls 3', 3", 3''', 3'''', which are interconnected at substantially upwardly extending corners 7 or corner edges 7 of the container 1, and which side walls 3', 3", 3''', 3'''' can together form a circumferential wall 3 of the container 1 or container body 1B. The container 1 or container body 1B, which may be open at its top side, may further comprise a bottom 2. Here, the container and the container body have, when seen in a substantially horizontal imaginary plane, a substantially rectangular cross section, which may be a substantially square cross-section. The container 1 may thus be a rectangular container. Alternatively, the cross-section may in other embodiments also be formed otherwise, preferably substantially in the form of a polygon. However, other formed container, such as for instance substantially round containers, may be possible as well.

The side walls or circumferential wall 3 may be sloping at least partly such that the container 1 or container body 1B is tapering in a downward direction towards its base 2. Due to said sloping, the cut flower container 1 can be nestable.

Figure 4:
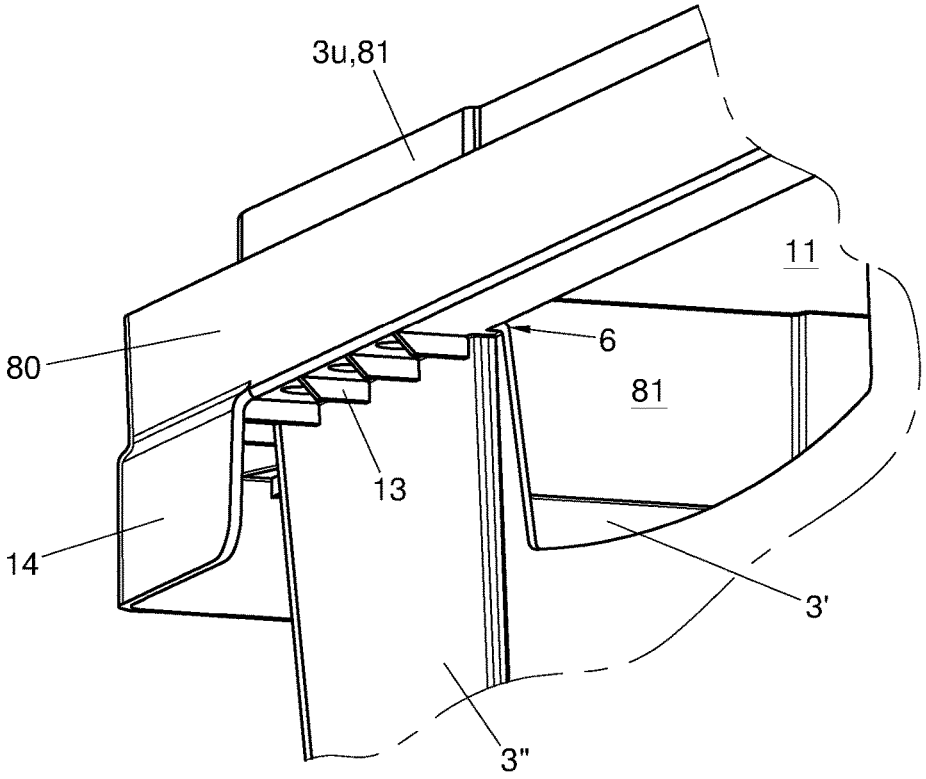
FIG. 4 shows a schematic perspective view of a detail of an alternative embodiment of a nestable cut flower container according to an aspect of the invention.

At an upper region, the container body 1B is provided with a channel-shaped sleeve holder 8, which may be formed as a substantially U shaped channel 8. The sleeve holder 8 is for holding a protective sleeve 20 (shown in dotted lines in FIG. 1). It is noted that said channel-shaped sleeve holder 8 is open at its top side or top end, and that it can have a channel bottom 8*c*, e.g. for interconnecting an outer channel wall 80 with an inner wall 81 of the channel 8. As for instance can be seen in FIGS. 2 and 4, said bottom may be provided with drain holes 82. Additionally or alternatively, also the inner channel wall 81 and/or the outer channel wall 80 may be provided with drain holes.

The channel-shaped sleeve holder 8 or so-called channel 8 may thus be used for receiving a protective sleeve 20 that is arranged for protecting the flowers in the container 1, e.g. during transport. Said protective sleeve 20 may provide additional protection to the cut flowers, for example when they are higher than the container 1 and extend out of the container 1. The protective sleeve 20 may be formed from a foldable sheet, e.g. a cardboard or plastic sheet, which may be provided with pre-fit folding lines. On such a protective sleeve 20, a lid 21 can be positioned on which a further container can be placed. Thereto, in advantageous embodiments, the top side of the lid 21 and/or a bottom side or base 2 of the container 1 may be arranged to engage each other in a manner that counteracts that an upper container easily slips off the lid of a lower container. Thus, also when the cut flower containers 1 are filled with flowers, the cut flower containers 1 can be stacked which can be advantageous during transport and/or storage. Preferably, the container 1 and the lid 21 can be arranged such that the lid 21 can be placed directly on top of the container, without using a protective sleeve 20.

Additionally or alternatively, a base 2 of the nestable cut flower container 1, especially its under surface may be arranged to engage a top end of the protective sleeve 20. The container 1 may then for instance be placed on the protective sleeve 20 to bring the container assembly into a display position or presentation position, whereas it previously could have been in a transport or storage mode when said protective sleeve 20 was for instance positioned in the channel-shaped sleeve holder 8 to protect cut flowers contained therein.

As can be seen in FIG. 1, the sleeve holder 8, or its bottom, may extend in an outward direction with respect to the side wall(s) 3 of the container 1. The channel-shaped sleeve holder 8, or so-called channel 8, may thus be an outwardly projecting channel 8.

The channel-shaped sleeve holder 8 has an outer channel wall 8*a* and at least one anti-interlocking flange 14, which may be formed as a flange or lip, and which extends downwardly from the outer channel wall 8*a*. As can be seen relatively well in FIG. 2, which shows a schematic perspective view of a detail of the nestable cut flower container 1 of FIG. 1, the anti-interlocking flange 14, or at least a bottom section of said anti interlocking flange, is staggered with respect to the outer channel wall 80, or at least a top section of said outer channel wall 80. At least a bottom section 14*a* of the anti-interlocking flange 14 is thus offset with respect to at least a top section of the outer channel wall 80 in a sideward or outward direction, especially substantially in the width direction of the channel 8.

Figure 2:
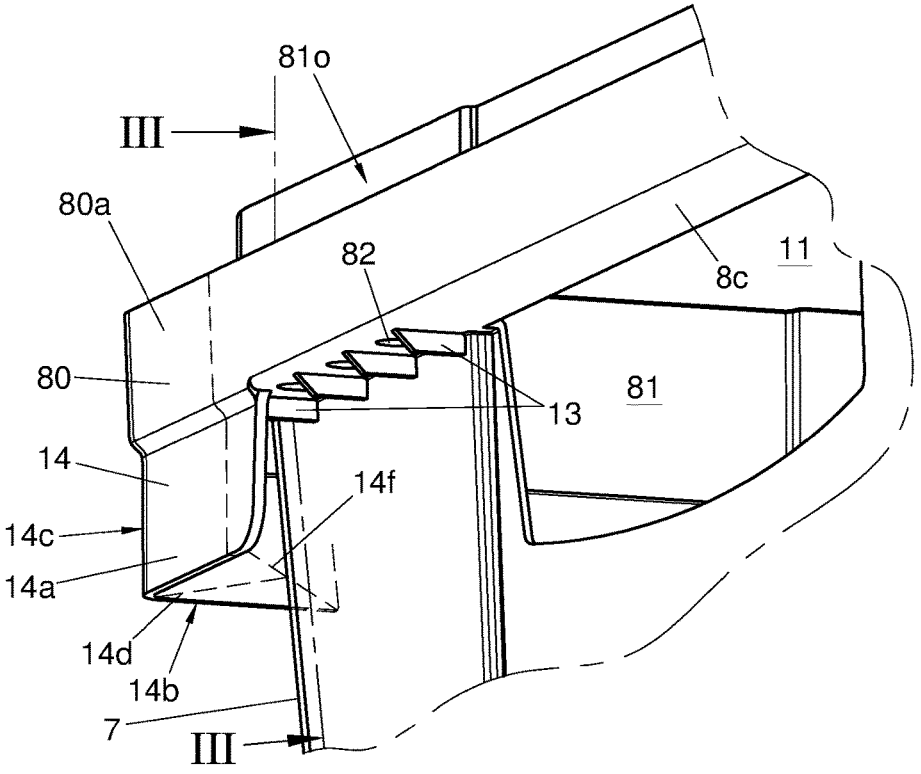
FIG. 2 shows a schematic perspective view of a detail of the nestable cut flower container of FIG. 1.
Figure 3:
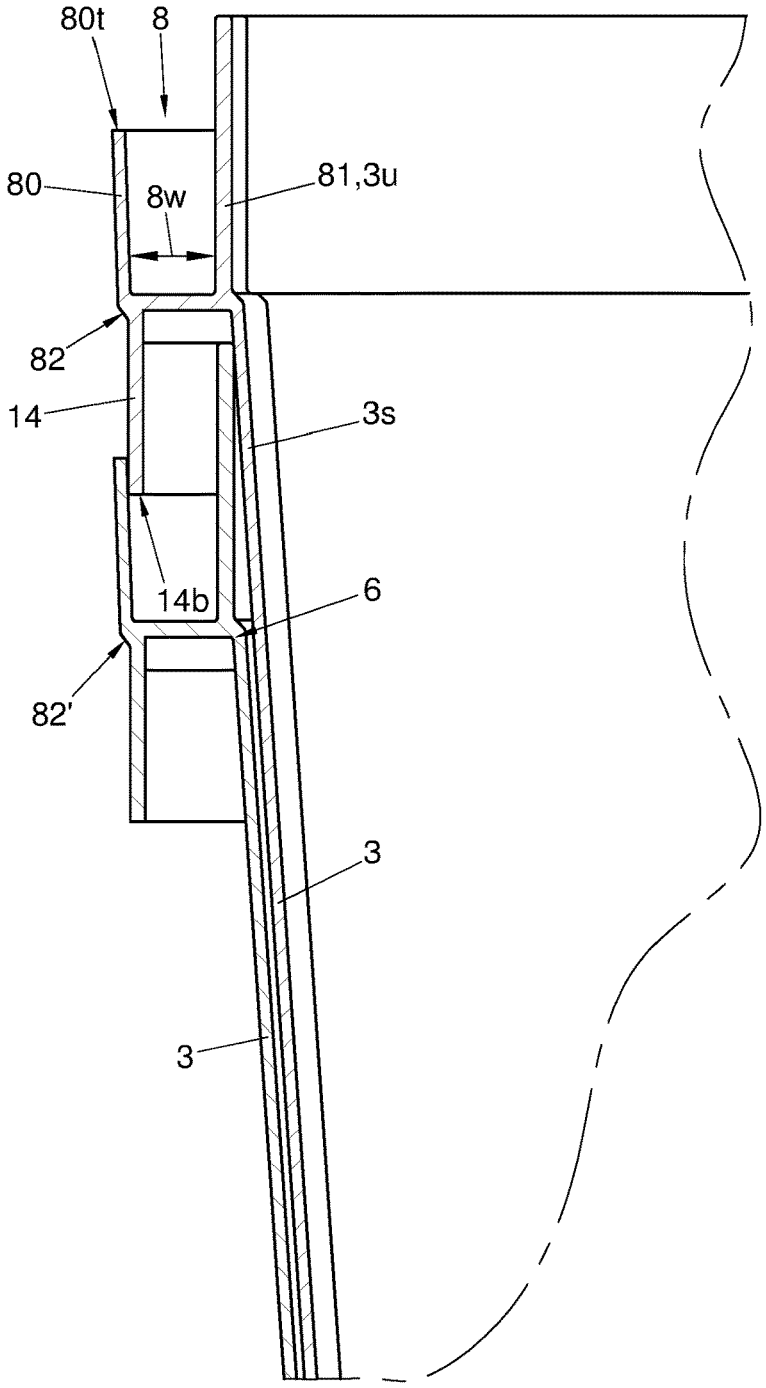
FIG. 3 shows a cross-section of a side wall of two containers according to the exemplary embodiment of FIGS. 1 and 2.

As best can be seen in FIG. 3, which shows a cross-sectional view of a side wall of two containers 1 according to the exemplary embodiment of FIGS. 1 and 2 nested into each other, such as a cross-sectional view along line III-III in FIG. 2, the bottom 14*b* or bottom edge 14*b* of the anti interlocking flange 14 does not rest on top of the outer wall 80 of the channel-shaped sleeve holder 8 of a lower container 1, but falls aside the outer wall 80 of the channel-shaped sleeve holder of said lower container, thereby facilitating a relative small nesting height of the cut flower containers 1. The nesting height may thus be reduced with respect to conventional nestable cut flower containers.

In the embodiments of FIGS. 1-3, the flange 14 is staggered inwardly with respect to said channel outer wall 80. However, in other embodiments, such as for instance the embodiment of FIGS. 4 and 5, the anti interlocking flange 14 can be staggered at least partly outwardly with respect to the channel outer wall 80.

Although the anti-interlocking flange 14 may in embodiments be substantially surrounding the circumference of the container 1, in other embodiments, only parts of the circumference of the container may be provided with anti-interlocking flanges 14. For example, in particular when the cut flower container 1 has substantially planar side walls 3 connecting to each other at corners 7 or so-called corner edges 7 of the container 1, at or near corners 7 of the container 1, the channel-shaped sleeve holder 8 may be provided with an anti-interlocking flanges 14. These anti-interlocking flanges 14 may then preferably be formed as corner flanges, and may be extending around said corner. By providing an anti-interlocking flange 14 at the corner of the container, it can be counteracted that—even if corner of a container is pointing towards another container—a portion, e.g. a corner portion, of the channel 8 slides onto a neighbouring container 1.

In preferred embodiments, the channel-shaped sleeve holder 8 and the corner flange 14 can be arranged such that the corner flange 14 cannot hook into a channel-shaped sleeve holder 8 of an adjacent similar nestable cut flower container. Thereto, as for instance can be seen in FIG. 1, the corner flange 14 or its bottom edge 14*b* can extend from a first end 14*e*' located at one side of a substantially upwardly extending corner 7 or corner edge 7 of the cut flower container 1 to a second end 14*e*" located at the other side of the corner 7 to such extent that a corner 14*c* of the corner flange 14 or its bottom edge 14*b* is located away from an imaginary straight line 14*f* interconnecting the two ends 14*e*', 14*e*" of the corner flange or its bottom edge over a distance 14*d* that is larger than a width 8*w*, especially a widest width 8*w*', between the outer channel wall 80 and an inner channel wall 81 of the channel-shaped sleeve holder 8. As a result, the corner flange 14 may be too big to fit in a channel 8 of another container, except when the containers are nested. When a container rises up, e.g. during transportation, and its corner flange 14 lands on top of a channel of an adjacent container, may thus be prevented from hooking into said channel 8.

Advantageously all anti-interlocking flanges 14 of the container 1 are arranged to prevent them from hooking into a channel-shaped protective sleeve holder 8. For example therefore, the container may be free of straight anti interlocking flanges 14 that do not turn around a corner 7 of the cut flower container 7.

By staggering or offsetting the anti-interlocking flange 14 with respect to the outer channel wall 80, an edge can become exposed. For example, in case of an inwardly staggered anti-interlocking flange 14, for instance such as in the embodiment of FIGS. 2 and 3, a bottom edge of the channel 8 can become exposed. Alternatively, in case of an outwardly staggered anti-interlocking flange 14, for instance such as in the embodiment of FIGS. 4 and 5, a top edge of the anti-interlocking flange 14 can become exposed. As it is undesirable that such exposed edges may cause interlocking of adjacent cut flower containers 1, the edges may be covered by means of a side or sliding surface 82', 83'.

For example, as it is undesirable that, at the location of an inwardly staggered anti-interlocking flange 14, the channel may still slide onto a channel of an adjacent container, such edge may be filled up with an inwardly sloping down filler portion 82 that may provide a sliding surface 82' or slide 82' to allow another container of which the channel 8 lands on top said channel 8 to slide down. Additionally or alternatively, the top edge 80*t* of the outer channel wall 80 may be bevelled off or chamfered such as to slope down in an outward direction in order facilitate that a container channel of a withered up neighbouring container can slide down again relatively easily.

Analogously, as it is undesirable that at the location of an outwardly staggered anti-interlocking flange 14 the anti-interlocking flange 14 may slide onto an anti-interlocking flange 14 of an adjacent container, such edge on top of the anti-interlocking flange 14 may be filled up with an inwardly sloping up filler portion 83 that may provide a sliding surface 83' or slide 83' to allow a container 1, of which the anti-interlocking flange 14 lands on top of another anti-interlocking flange 14, to slide down. Additionally or alternatively, the bottom edge 14*b* of the anti-interlocking flange 14 may be bevelled off or chamfered such as to slope down in an inward direction in order facilitate that an anti-interlocking flange 14 of a withered up container can slide down relatively easily.

The inner channel wall 81, which preferably may extend substantially parallel with the outer channel wall 80 of the channel-shaped sleeve holder 8, may at least partly extend above the outer channel wall 80, e.g. about a top edge 80*t* of the outer channel wall 80. As a result of at least parts of the inner channel wall 81 then thus being relatively high with respect to the outer channel wall 80, a protective sleeve 20, which for example may be formed a foldable strip comprising folding lines, can be supported on the outer side face 81*o* of (at least a relatively high portion of) the inner wall 81 of the channel 8 when said protective sleeve 20 is pressed there against when it 20 is folded around cut flowers disposed in the container 1, whereas the outer wall 80 of the channel 8 can then thus be relatively low with respect to (at least portions of) said inner channel wall 81 such that the protective sleeve 20 may relatively easily be moved over said outer channel wall 80 towards the upper portion 81*u* of the inner channel wall 81 extending above the outer channel wall 80. The inner channel wall 81 can thus form a support 81*o* or stop 81*o* for facilitating folding the protective sleeve 20, e.g. folding it around cut flowers, which for instance may hang over the top edge 81*t* of said inner channel wall 81 in an outward direction.

It is noted that the channel-shaped sleeve holder 8 can be located at the upper end of the container 1. Additionally or alternatively, a top edge 81*t* of the inner channel wall 81 may form the top side of the container 1.

Furthermore, it is noted that the inner wall 81 of the channel 8 can form an upper wall part 3*u* of side wall 3 of the container 1 or container body 1*b*. A lower wall part 3*s* may be formed by a sloping portion 3*s* of the side wall 3.

In embodiments, at least along a portion of the circumference of the container 1, a shoulder 6 may be present between said upper wall part 81 and a corresponding lower wall part 3*s* of the container. Said shoulder 6 may extend in a substantially sideward direction, or at least in an at least partly sideward direction. For example, the bottom 8*c* of the channel 8 can extend in line with said shoulder 6 such that the bottom 8*c* of the channel 8 can approximately be at the same height as the shoulder 6, wherein the channel 8 then can be at the outer side of the side wall 3 and the shoulder 6 is at the side facing the side wall 3. Nevertheless, in alternative embodiments, the bottom 8*c* may be positioned lower than the shoulder 6, or may be positioned higher than the shoulder 6.

Said shoulder 6, or multiple of such shoulders 6, may serve as a support (or supports) for a presentation collar or a so-called presentation sleeve, and/or as a support (or supports) for an other accessory, such as a long stem holder, a partition board, a container interior, a presentation card holder, a container extension, a water container, a container interior, a sign holder, a presentation card, a price tag, an interior for holding individual flowers in place, or another suitable accessory.

In embodiments, the cut flower container 1, for instance at a shoulder 6 thereof, may be provided with a cooperating element 12 for cooperating with an accessory, especially an accessory to be supported on such shoulder 6, to fixate the accessory to the container, e.g. by fixating it at least partly to such shoulder 6. For example, the cooperating element 12 may comprise and/or may be formed as an insertion opening or slit, a click finger, a protrusion, especially an upwardly extending protrusion, such as a finger, a pin, a U-shaped element, an L-shaped element, a clamping element etc. The cooperating element 12 may cooperate with a connection element of the accessory, which connection element may for example be one of an opening, a finger, a pin, a protrusion, a rib, a ridge, a pre-punched hole. In case said cooperating element 12 of the container 1 is provided at the shoulder 6, a depth of the cooperating element can preferably be smaller than a depth of the shoulder 6, wherein said depths can be measured transverse to the side wall 3.

The nestable cut flower containers 1 can be nested when being empty. Additionally or alternatively to inclining the lower wall part 3*s*, an offset may be provided between a lower wall part 3*s* and an upper wall part 3*u*, which preferably may form the inner wall 81 of the channel 8, such that the container 1 may be nestable, or nestable relatively well. In an upward direction from the base 2, the lower wall part 3*s* can incline somewhat outwardly such that the container 1 near the shoulder 6 then can be wider than at the base 2. The upper wall part 3*u* or inner channel wall 81 may then extend substantially straight upwardly with respect to the inclined lower wall part 3*s*.

Figure 5:
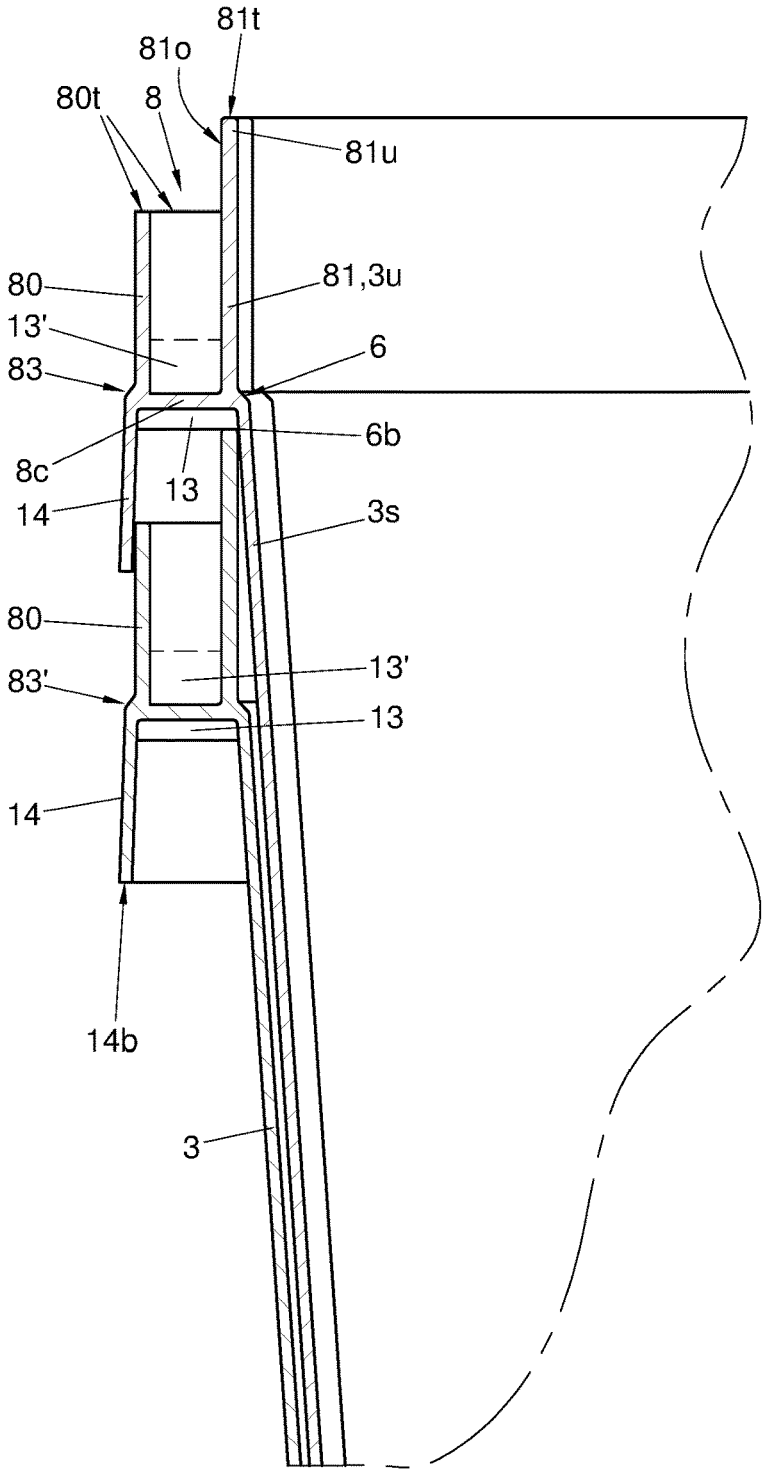
FIG. 5 shows a cross-section of a side wall of two containers according to the embodiment of FIG. 4.

When the cut flower containers 1 are empty, an upper cut flower container 1 may be received in a lower cut flower container 1 as to be nested in the lower cut flower container 1. In embodiments, the upper container may then rest with a lower side 6*b* of its shoulder 6 and/or a bottom 80*c* of the channel-shaped protective sleeve holder 8 onto the inner channel wall 81 of a lower container 1. However, in alternative embodiments, e.g. when the bottom 8*c* of the channel 8 is provided with ribs 13 for providing stiffness and/or strength to the channel 8, such rib 13 may then rest with its lower side onto the inner channel wall 81, such as is shown in FIGS. 3 and 5. For instance to improve the nesting height even further, the inner channel wall 81 of the container 1 may be provided with one or more recesses or cut-outs to accommodate one or more ribs 13 of an upper container.

Alternatively or additionally, stiffening ribs 13', an embodiment of which is shown as a dotted line in FIG. 5, can be provided in the channel 8, e.g. on an upper side of its bottom 80*c*. Then, the protective sleeve 20 may at its bottom edge be provided with recesses or cut-outs to allow passage of such upwardly protruding stiffening rib.

It will be apparent that the container 1 or the container body may arranged to contain water for cut flowers, e.g. during transport thereof It is noted that at least a bottom part of the container 1 may form a water reservoir 1R. For example, the base 2 and at least partly the side wall(s), which can preferably be made of a plastic material, can form the water reservoir 1R. Thereto, they may at least partly be substantially water tight or substantially impermeable to water, such that flowers held in the cut flower container 1 can be provided with water to counteract that cut flowers wither up during transporting, storing, and/or displaying the flowers.

Nevertheless, the side wall 3, especially a relatively high location may be provided with one or more, preferably at least two, hand grip openings 11, e.g. provided in opposite side walls 3", 3"" or opposite side wall portions. For example, such a hand grip opening 11 may extend upwardly up to the bottom 8*c* of the channel-shaped sleeve holder 8. For example, a or the anti-interlocking flange 14 may be interrupted at the location of such hand grip. It is noted that at the location of such hand grip opening 11 the channel-shaped sleeve holder may be free of the or an anti interlocking flange 14. In stead of providing one or more hand grip openings 11, or additionally thereto, other handles may be provided, which for instance can be arranged as grip or holding rib.

Although the hand grip openings 11 may provide ventilation for cut flowers transported and/or stored by means of the container 1, the container 1, especially its side wall(s) 3 may alternatively or additionally be provided with one or more ventilation openings to provide ventilation to the cut flowers.

Further, it is noted that the invention is not restricted to the embodiments described herein. It will be understood that many variants are possible and many variants will be apparent to the person skilled in the art. Such variants will be apparent for the person skilled in the art and are considered to lie within the scope of the invention as formulated in the following claims.

What is claimed is:

1. A container for cut flowers, the container being nestable, the container comprising a container body which at an upper region is provided with a channel-shaped sleeve holder, which the channel-shaped sleeve holder is open at its top, and which the channel-shaped sleeve holder is for holding a protective sleeve arranged to protect cut flowers, the channel-shaped sleeve holder having an outer channel wall, the container further comprising at least one anti-interlocking flange extending downwardly from the channel-shaped sleeve holder, the at least one anti-interlocking flange preventing the channel-shaped sleeve holder of the container from becoming unintentionally interlocked with a first container located adjacent the container, wherein the at least one anti interlocking flange, or at least a bottom section of the at least one anti interlocking flange, is staggered with respect to the outer channel wall, or at least a top section of the outer channel wall, to such extent that, when seen from above, the at least one anti-interlocking flange, or at least the bottom section thereof, is not even partially overlapping with the outer channel wall, or at least not even partially overlapping with the top section of the outer channel wall, and wherein a combined height of the outer channel wall and the at least one anti-interlocking flange is larger than a nesting height of the container when the container is nested with a second container, such that when the container is nested into the second container, the bottom of the at least one anti-interlocking flange of the container does not rest on an outer wall of a channel-shaped sleeve holder of the second container, but falls aside the outer wall of the channel-shaped sleeve holder of the second container, thereby facilitating that the nesting height is relatively smaller as compared to the combined height of the outer channel wall of the container and the at least one anti-interlocking flange of the container.

2. The container according to claim 1, wherein, in a substantially horizontal imaginary plane, the container and/or the container body has a substantially polygonal cross section, such as for instance a substantially rectangular cross section.

3. The container according to claim 2, wherein at or near at least one corner of the container, the channel-shaped sleeve holder is provided with at least one of the at least one anti-interlocking flanges.

4. The container according to claim 3, wherein the at least one of the anti-interlocking flanges is provided at or near a respective corner of container, is, in circumferential direction of the container, extending around the respective corner.

5. The container according to claim 1, wherein at least one of the at least one anti-interlocking flanges is a corner flange.

6. The container according to claim 5, wherein the channel-shaped sleeve holder and the corner flange are arranged such that the corner flange cannot hook into a channel-shaped sleeve holder of an adjacent similar container for cut flowers.

7. The container according to claim 5, wherein the corner flange, or its bottom edge, extends from a first end that is located at one side of a corner or corner edge of the container to a second end that is located at another side of the corner to such extent that the distance of a first imaginary straight line between the corner of the corner flange or its bottom edge and a second imaginary straight line interconnecting the two ends of the corner flange, or of its bottom edge, is larger than a width between the outer channel wall and an inner channel wall of the channel-shaped sleeve holder.

8. The container according to claim 1, wherein the at least one anti-interlocking flange substantially surrounds a circumference of the container.

9. The container according to claim 1, wherein the channel-shaped sleeve holder substantially surrounds a circumference of the container.

10. The container according to claim 1, wherein the channel-shaped sleeve holder has an inner channel wall, and wherein at least parts of the inner channel wall are at least partly extending above a top edge of the outer channel wall.

11. The container according to claim 1, wherein the container is arranged to contain water for cut flowers.

12. The container according to claim 1, wherein the channel-shaped sleeve holder is located at an upper end of the container, and/or wherein a top edge of an inner channel wall forms a topside of the container.

13. The container according to claim 1, wherein at least a portion of an inner channel wall of the channel-shaped sleeve holder forms an upper wall part of a side wall of the container, and wherein, at least along a portion of a circumference of the container, a shoulder is present between the upper wall part and a corresponding lower wall part of the container.

14. A container assembly for cut flowers, comprising the container according to claim 1 and further comprising at least one of a protective sleeve and a lid.

15. A set of at least two containers according to claim 1.

16. The set according to claim 15, wherein at least one of the containers is nested into another one of the containers.

17. A kit of parts, comprising the container according to claim 1 and further comprising at least one of a protective sleeve and a lid.

* * * * *